United States Patent [19]

Perry, Jr. et al.

[11] Patent Number: 5,027,459

[45] Date of Patent: Jul. 2, 1991

[54] AUXILIARY FRAME AND GRID AND INTERACTION WITH MATTRESS PERIPHERY

[76] Inventors: Leroy R. Perry, Jr., 1301 E. Rubio St., Altadena, Calif. 91001; Earl Kluft, 1045 Hampton Rd., Arcadia, Calif. 91006

[21] Appl. No.: 335,508

[22] Filed: Apr. 10, 1989

[51] Int. Cl.[5] ..... A47C 23/04

[52] U.S. Cl. ..... 5/475; 267/97; 5/478

[58] Field of Search ..... 5/475, 476, 477, 478; 267/96, 97, 110

[56] References Cited

U.S. PATENT DOCUMENTS

| | | | |
|---|---|---|---|
| 681,124 | 8/1901 | Lally | 5/475 |
| 2,002,157 | 5/1935 | Reed | 267/97 |
| 2,610,334 | 9/1952 | Piliero . | |
| 2,675,566 | 4/1954 | Lieberman . | |
| 2,709,819 | 6/1955 | Wise . | |
| 2,755,215 | 7/1956 | Talalay et al. | 5/478 |
| 3,032,782 | 5/1962 | Sharfe et al. . | |
| 3,242,505 | 3/1966 | Tyhanic . | |
| 3,502,316 | 3/1970 | Saether | 267/110 |
| 3,596,299 | 8/1971 | Klicki | 5/476 |
| 3,636,574 | 1/1972 | Kramer | 5/478 |
| 3,722,013 | 3/1973 | Surletta | 5/476 |
| 4,324,011 | 4/1982 | Cavaler | 5/248 |
| 4,326,311 | 4/1982 | Paipovich . | |
| 4,369,534 | 1/1983 | Wright | 5/475 |
| 4,476,595 | 10/1984 | Ikeda | 5/478 |
| 4,662,011 | 5/1987 | Duvivier . | |

FOREIGN PATENT DOCUMENTS

| | | | |
|---|---|---|---|
| 502156 | 5/1954 | Canada | 267/97 |
| 630944 | 11/1961 | Canada | 5/475 |
| 439165 | 6/1912 | France | 267/97 |
| 534679 | 3/1941 | United Kingdom | 5/475 |

*Primary Examiner*—Eric K. Nicholson
*Attorney, Agent, or Firm*—William W. Haefliger

[57] ABSTRACT

A mattress construction includes upper and lower structures defining generally parallel planes, and coil springs operatively connected to such structures and located between those planes, and with:

(a) at least one of the upper and lower structures including a first grid, (b) and band apparatus extending at the periphery of the mattress and connected with the first grid to interact therewith and transmit force for tensioning the grid.

The mattress construction also enables treating of a patient having a spinal condition for which traction is recommended by suspending the patient's body to extend generally horizontally on a "trampoline" grid mattress surface which interacts with the mattress border perimeter structure to create a surface lift and therefore stretch reflex on the patient's body. This surface lift is transmitted vertically in a rebound proportional to the weight and movement of the body or bodies on it to further transmit forces horizontally to the perimeter border surface and substructures creating an elongation and decompression of the patient's spine.

20 Claims, 2 Drawing Sheets

AUXILIARY FRAME AND GRID AND INTERACTION WITH MATTRESS PERIPHERY

BACKGROUND OF THE INVENTION

This invention relates generally to mattresses, and more particularly to easily oppenable means to increase the "firmness" of mattresses.

There is need for mattress constructions in which the firmness or hardness of the mattress is determined by means other than the strength or number of coil springs used. While it is known to provide a wire mesh overlying the coil springs of the mattress, no way was known to employ a sub-frame and to tension it by interaction with the periphery of the mattress, and in the simple, easily attachable manner provided by the present invention, thereby avoiding need to attach each of the wires of the sub-frame directly to the frame of the mattress. Also, no way was known to enable ready detachment of a mattress stiffening wire mesh from the main mattress.

SUMMARY OF THE INVENTION

It is a major object of the invention to provide an improved mattress construction meeting the above need.

It is another object to provide a tensionable grid for application to a mattress, the grid being easily attachable.

It is a further object of the invention to provide an improved grid which incorporates a looping sub-frame to which grid wires are attached, the sub-frame then being easily attachable to the main outer frame of a mattress. In this regard, non-metallic band means may be employed for securing such attachment in an easy, load distributing, manner, for tensioning the grid and its sub-frame. This also facilitates ease of removal of the grid by ready detachment of the band means.

As will appear, the band means may include multiple bands which are spaced apart and extend to different locations of support at the periphery of the mattress; the bands may consist of flat, flexible, fabric of high tensile strength or metal band or other materials to produce greater rigidity; and they may easily be secured to the main frame by looping connection about a frame member.

It is a further object to provide band connection configurations that interact with both upper and lower outer frames of the mattress; and a third such frame may be employed between the upper and lower outer frames, to interact with the bands, as during imposition of loading on the mattress, to tension the grid and its sub-frame.

Both upper and lower grids, and sub-frames may be provided, and the bands may interconnect them in a tensioning mode, with band interaction via the main frame members of the mattress, as will be seen.

These and other objects and advantages of the invention, as well as the details of an illustrative embodiment, will be more fully understood from the following specification and drawings, in which:

DRAWING DESCRIPTION

FIG. 1 is a perspective view of a mattress embodying the invention;

FIG. 1*a* is a plan view of a plastic grid;

DETAILED DESCRIPTION

Figure 1:
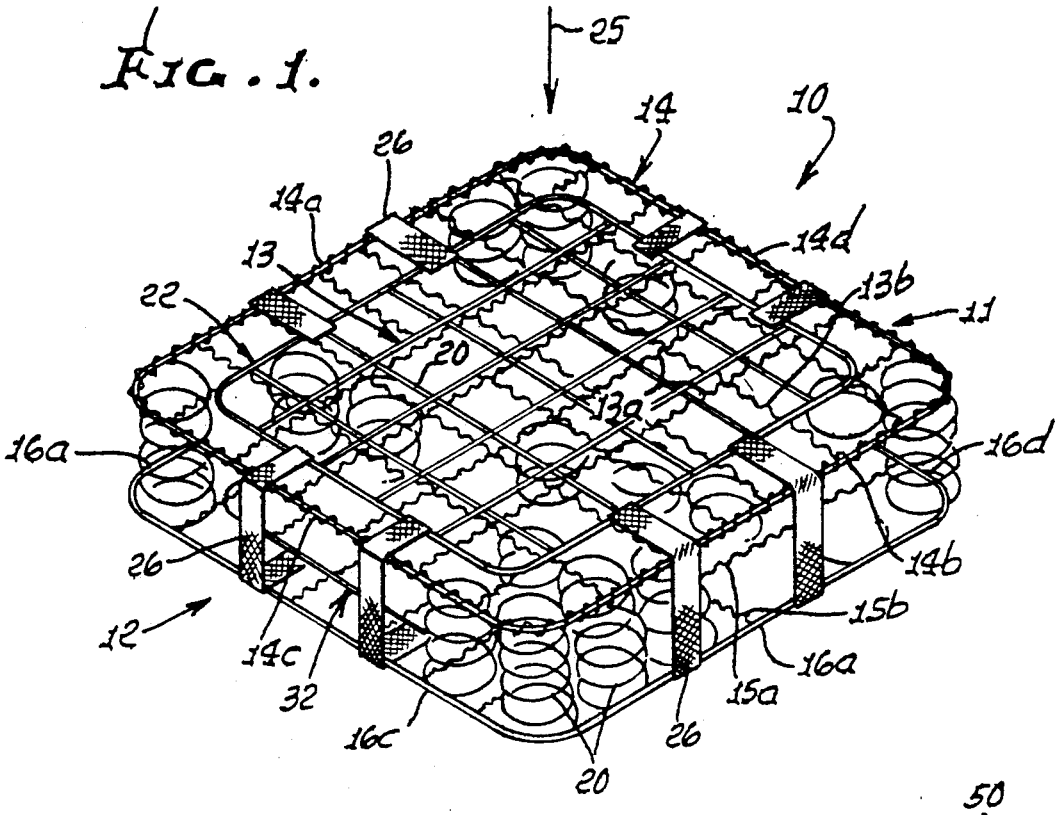
Figure 3:
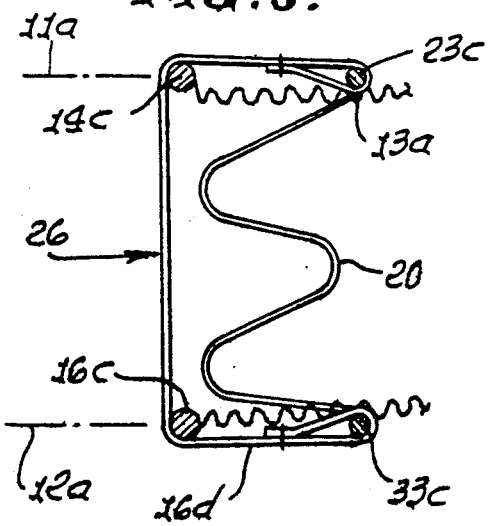
FIGS. 3–6 are schematic, fragmentary, elevations showing tensioning of grids by various band arrangements, FIG. 3 taken on lines 3—3 of FIG. 2.
Figure 2:
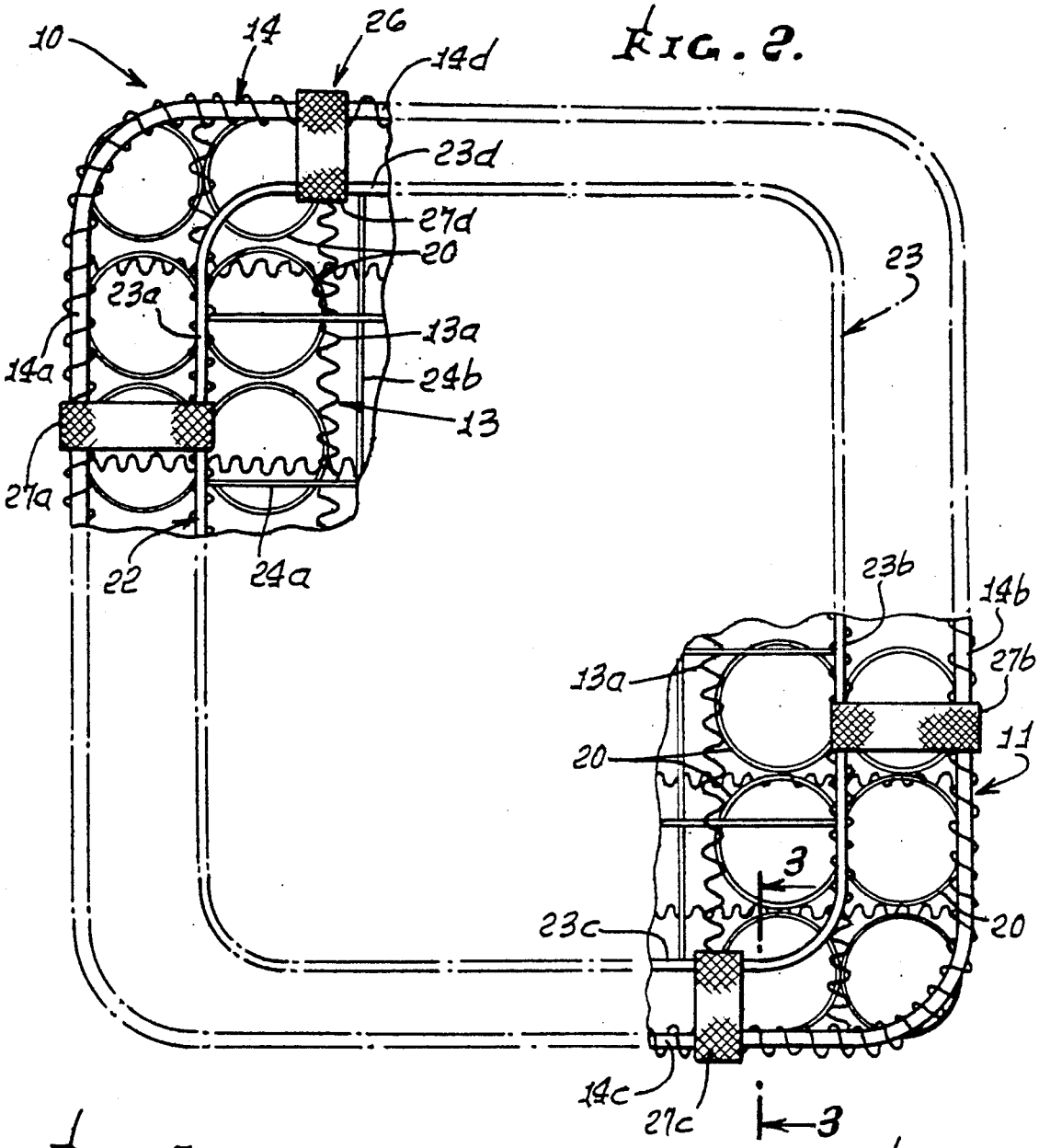
FIG. 2 is a top plan view of a corner portion of the mattress.

In FIGS. 1–3 a mattress construction 10 includes upper and lower structures 11 and 12 defining generally parallel planes 11*a* and 12*a*. Metallic coil springs 20 are positioned between 11 and 12 in lateral and longitudinal rows as is clear from FIG. 2, and the tops and bottoms of the springs are attached to such structures 11 and 12. For example, structure 11 includes an upper mesh 13 integrated with heavy metal looping upper frame 14, the latter including longitudinal horizontal lengths 14*a* and 14*b*, and lateral horizontal lengths 14*c* and 14*d*. Mesh 13 includes elongated longitudinal strands 13*a* and elongated lateral stands 13*b*. Those strands 13*a* and 13*b* typically define tight, small coils along their lengths. The ends of coiled strands 13*a* are connected to frame lengths 14*c* and 14*d*; and the ends of coiled strands 13*b* are connected to frame lengths 14*a* and 14*b*.

Similarly, structure 12 includes a lower mesh 15 integrated with heavy metal looping lower frame 16, the latter including longitudinal horizontal lengths 16*a* and 16*b*, and lateral horizontal lengths 16*c* and 16*d*. Mesh 15 includes elongated longitudinal strands 15*a* and elongated lateral strands 15*b*. Those strands 15and 15*b* typically define tight coils along their lengths.

In accordance with one aspect of the invention, the upper structure 11 includes a first grid 22, seen in FIG. 2 as overlying the mesh 13. That grid includes a sub-frame 23 extending in a loop and having heavy sub-frame longitudinal lengths 23*a* and 23*b*, and lateral lengths 23*c* and 23*d*. The latter are respectively spaced inwardly from frame lengths 14*a*–14*d*, as shown. The first grid 22 also includes mesh strands 24*a* and 24*b*, the strands 24*a* consisting of wires that extend longitudinally with their ends connected to 23*a* and 23*b* and the strands 24*b* consisting of wires that extend laterally, with their ends connected to 23*a* and 23*b*. Wires 24are preferably of heavier gage than wires 24*b*, or 24b may be of heavier gage than 24*a*.

Further in accordance with the invention, means is provided to extend at the periphery of the mattress and to be connected with the first grid, to interact with same and transmit force for tensioning the first grid—i.e. laterally and/or longitudinally, for example. This enables the first grid and to resist deflection vertically under loading imposed vertically (see arrow 25 in FIG. 1), thereby adding materally to the "hardness" of the mattress, as desired by many persons. Accordingly, an existing "soft" mattress as in FIG. 1 can easily be connected to a harder mattress, by use of the first grid 22.

Such means attaching the grid 22 to the mattress typically includes band means extending from the frame lengths 23*a*–23*d* of the first grid to different portions of the mattress periphery. As shown in FIG. 2, the band means is seen to include multiple flat bands or straps 26 which are spaced apart to extend at different locations (27*a*–27*d*, for example) of support at the periphery of the mattress. Each band typically and preferably consists of strong, flexible, flat fabric, one good example being TEFLON, or metal band or other materials to produce greater rigidity, the band being between ½ and 1 inch in width, and having its opposite ends wrapped about and attached to frame and sub-frame lengths. The flatness of the bands prevents snagging with bedding such as padding placed upon the mattress. Also, the bands 26 position as well as tension the grid 22, in use. The band may be stapled, crimped or looped to frame lengths 23c and 14c for example. The bands remain tensioned during mattress deflection.

In FIG. 3, the band 26 wraps partly about 14c and 16c and then also extends at 16d toward a lower grid 32, i.e. toward frame length 32c, for attachment thereto. Thus, both grids 32 and 22 interact with one another, and with the frame lengths 14c and 16c, under imposed loading to tension the grids. Lower grid 32, which is part of 12, has the same construction as the upper grid 22, with corresponding elements as follows:

(multiple bands connect the upper and lower frames):

| Upper grid | Lower grid |
|---|---|
| 22 | 32 |
| 23 | 33 |
| 23a | 33 |
| 23b | 33b |
| 23c | 33c |
| 23d | 33d |

Figure 4:
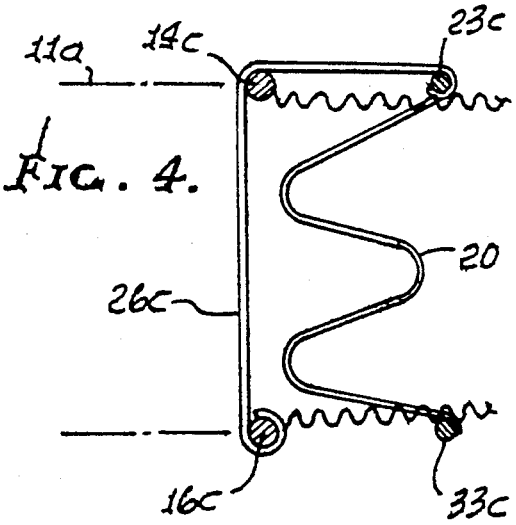
Figure 5:
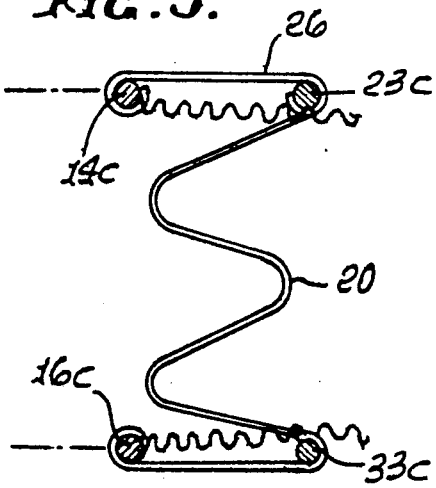

In FIG. 4, the band 26 is attached at 26a to grid frame length 23c; it extends toward and wraps partly about frame length 14c, and then extends downward at 26c for wrapping about and attachment to lower frame member 16c. This causes interaction between both frame members 14c and 16c and the grid 22, under imposed loading, for tensioning the grid. Also the bands hold the frames 14 and 16 in predetermined spaced relation in the absence of loading, but tensioned toward one another. In FIG. 5, separate upper and lower bands 26 are provided; upper band 26 connecting 14c and 23c, and lower band 26 connecting 16c and 33c. Multiple of such bands 26 are spaced adjacent the mattress, on all four sides.

Figure 6:
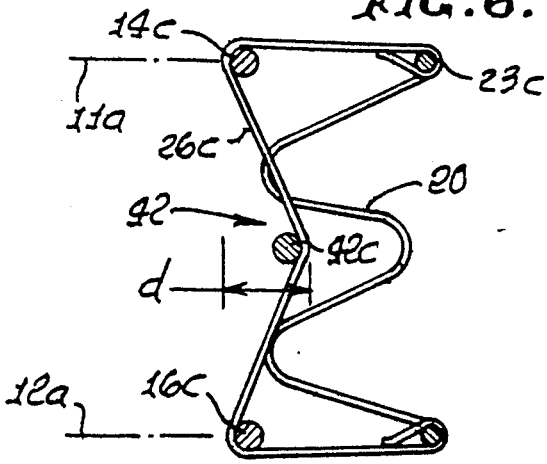

In FIG. 6, the construction is the same as in FIG. 3, but an additional or third frame 42 forms a loop with four lengths 42 a–42d, each spaced inwardly of the mattress periphery, as by distance "d", and spaced between planes 11a and 12a. The band lengths 26c loop partly about the length 42a–42d, at their inward facing sides, tending to pull those lengths outwardly at all times, since the bands are tensioned at all times. In this way, the two grids 22 and 32 both interact with and are tensioned by all these frames 22, 32 and 42, under imposed loading, and the bands position the frames.

Figure 1A:
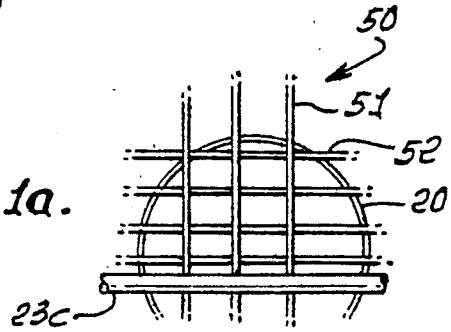

Finally, an additional unitary grid consisting of longitudinal and lateral strands of plastic, may be provided as at 50 in FIG. 1a. The strands 51 and 52 are fused together at their interconnections, and the grid 50 is not peripherally connected to the mattress but merely meshes with or underlies the grid 22, to cushion same. Grid 50 is retained in position by tensioned grid 22.

The invention may be considered to relate generally to rehabilitation equipment and to apparatus usable in conjunction with a mattress to aid or achieve therapeutic decompression of the spine. The problem of decreasing pressure on the spine, discs, nerve roots, and associated anatomy to relieve pain is a continuing one. There is abundant need for effective apparatus and techniques to achieve and/or facilitate such pain relieving spinal decompression, which the present invention meets.

We claim:

1. In a mattress construction including upper and lower structures defining generally parallel planes, and coil springs operatively connected to said structures and located between said planes, the improvement that comprises (a) at least one of said upper and lower structures including a first grid, (b) tensioned band means extending at the periphery of the mattress and directly connected with the first grid to interact therewith and transmit force for tensioning of the grid, (c) and a unitary plastic strand grid in addition to and extending in underlying relation to said first grid, and retained in position relative thereto, said plastic strand grid including longitudinal and lateral strands of plastic fused together at their intersections.

2. The improvement of claim 1 wherein said band means extends from the first grid to different portions of the mattress periphery.

3. The improvement of claim 2 wherein said band means includes multiple bands which are spaced apart and extend to different locations of support at the periphery of the mattress.

4. The improvement of claim 2 wherein said band means comprises flexible, flat fabric.

5. The improvement of claim 3 wherein the mattress has edge portions, and said multiple bands comprise flexible flat fabric looping over said edge portions of the mattress.

6. The improvement of claim 5 wherein said upper and lower structures include upper and lower metallic frames defining upper and lower peripheral edges of the mattress, the band looping over at least one of the frames.

7. The improvement of claim 6 wherein the bands loop over and connect to that frame which extends peripherally outwardly of the first grid.

8. In a mattress construction including upper and lower structures defining generally parallel planes, and coil springs operatively connected to said structures and located between said planes, the improvement that comprises (a) at least one of said upper and lower structures including a first grid, (b) and means including bands extending at the periphery of the mattress and connected with the first grid to interact therewith and transmit force for tensioning the grid, (c) said upper and lower structures including upper and lower metallic frames defining upper and lower peripheral edges of the mattress, (d) the bands looping over both of the frames and being connected with that frame which is further from the grid.

9. In a mattress construction including upper and lower structures defining generally parallel planes, and coil springs operatively connected to said structures and located between said planes, the improvement that comprises (a) at least one of said upper and lower structures including a first grid, (b) and means including bands at the periphery of the mattress and connected with the first grid to interact therewith and transmit force for tensioning the grid, (c) said upper and lower structures including upper and lower metallic frames defining upper and lower peripheral edges of the mattress, the bands looping over at least one of the frames, (d) the other of said upper and lower structures including a second grid, the bands looping over both frames and being connected with the second grid.

10. The improvement of claim 1 wherein the other of said upper and lower structures includes a second grid, and including other means extending at the periphery of the mattress and connected with the second grid to interact therewith and transmit force for tensioning the second grid.

11. The improvement of claim 3 wherein the other of said upper and lower structures includes a second grid, and including other multiple bands which are spaced apart and extend to different locations of support at the periphery of the mattress, said other multiple bands also anchored to the second grid to interact therewith and transmit force for tensioning the second grid.

12. The improvement of claim 11 wherein the other multiple bands comprise flexible, flat fabric, or metal to provide rigidity.

13. The combination of claim 1 wherein said first grid comprises elongated, flexible, metallic members.

14. The combination of claim 10 wherein each of the first and second grids comprises elongated, flexible, metallic members.

15. In a mattress construction including upper and lower structures defining generally parallel planes, and coil springs operatively connected to said structures and located between said planes, the improvement that comprises (a) at least one of said upper and lower structures including a first grid, (b) and band means extending at the periphery of the mattress and connected with the first grid to interact therewith and transmit force for tensioning of the grid, (c) the other of said upper and lower structures includes a second grid, and including other means extending at the periphery of the mattress and connected with the second grid to interact therewith and transmit force for tensioning the second grid, (d) and including additional grids respectively superimposed upon said first and second metallic grids, said additional grids consisting of elongated, flexible, plastic strands, fused at their intersections, and defining additional unitary structures.

16. In a mattress construction including upper and lower structures defining generally parallel planes, and coil springs operatively connected to said structures and located between said planes, the improvement that comprises (a) at least one of said upper and lower structures including a first grid, (b) and means extending at the periphery of the mattress and connected with the first grid to interact therewith and transmit force for tensioning the grid, (c) said band means extending from the first grid to different portions of the mattress periphery, (d) said band means including multiple bands which are spaced apart and extend to different locations of support at the periphery of the mattress, (e) said multiple bands comprising flexible flat fabric looping over said edge portions of the mattress, (f) said upper and lower structures including upper and lower metallic frames defining upper and lower peripheral edges of the mattress, the bands looping over at least one of the frames, (g) the other of said upper and lower structures including a second grid, the bands looping over both frames and being connected with the second grid, (h) and including a third metallic frame extending generally horizontally between said parallel plants, and at the mattress periphery, but closer to the mattress interior than said upper and lower frames, the bands looping about the third frame at the side thereof closest to the mattress interior.

17. The combination of claim 16 wherein the plastic strand grid is retained between the first grid and said coil springs.

18. The combination of claim 2 wherein the band means is pre-tensioned and remains tensioned during imposition of loading on the mattress.

19. In a mattress construction including upper and lower structures defining generally parallel planes, and coil springs operatively connected to said structures and located between said planes, the improvement comprising (a) at least one of said upper and lower structures including a first grid, (b) said grid comprising an auxiliary metallic frame forming a peripheral loop spaced inwardly from the mattress periphery, and flexible, elongated metallic strands extending in criss-cross relation and having ends connected to said auxiliary frame, (c) and an additional, unitary plastic strand grid extending in underlying relation to said first grid, and retained in position relative thereto.

20. The improvement of claim 19 wherein the grid includes a metallic frame, and including band means attached to the grid metallic frame and attached to portions of the mattress at the periphery thereof.

* * * * *